US009435547B2

(12) United States Patent
Lee et al.

(10) Patent No.: US 9,435,547 B2
(45) Date of Patent: Sep. 6, 2016

(54) INDOOR DEVICE FOR AN AIR CONDITIONER

(71) Applicant: LG ELECTRONICS INC., Seoul (KR)

(72) Inventors: Yungkoo Lee, Seoul (KR); Jungwoo Lee, Seoul (KR); Jaehyuk Jung, Seoul (KR); Geunho Jin, Seoul (KR); Dongsoo Moon, Seoul (KR); Kidong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 480 days.

(21) Appl. No.: 14/079,783

(22) Filed: Nov. 14, 2013

(65) Prior Publication Data

US 2014/0131018 A1 May 15, 2014

(30) Foreign Application Priority Data

Nov. 15, 2012 (KR) ..... 10-2012-0129192

(51) Int. Cl.

| | |
|---|---|
| ***F28F 9/007*** | (2006.01) |
| ***F24F 1/00*** | (2011.01) |
| ***F04D 17/16*** | (2006.01) |
| ***F04D 29/051*** | (2006.01) |
| ***F04D 29/058*** | (2006.01) |
| ***F04D 29/66*** | (2006.01) |

(52) U.S. Cl.

CPC ..... *F24F 1/0022* (2013.01); *F04D 17/16* (2013.01); *F04D 29/051* (2013.01); *F04D 29/058* (2013.01); *F04D 29/668* (2013.01)

(58) Field of Classification Search

CPC .... F04D 17/16; F04D 20/051; F04D 29/058; F04D 29/668; F24F 1/0022

See application file for complete search history.

(56) References Cited

U.S. PATENT DOCUMENTS

| | | | | |
|---|---|---|---|---|
| 2006/0185382 | A1 | 8/2006 | Kim et al. | |
| 2007/0114868 | A1 | 5/2007 | Horng et al. | |
| 2010/0242518 | A1 | 9/2010 | Yang | |
| 2011/0280753 | A1 | 11/2011 | Chen | |
| 2012/0301277 | A1 | 11/2012 | Chang et al. | |
| 2013/0248149 | A1* | 9/2013 | Kim et al. | F28F 7/00 165/104.19 |

FOREIGN PATENT DOCUMENTS

| | | |
|---|---|---|
| EP | 1 816 405 | 8/2007 |
| JP | 3174362 | 2/2012 |
| KR | 10-2009-0080425 | 7/2009 |

OTHER PUBLICATIONS

International Search Report dated Feb. 20, 2014.
European Search Report dated Jun. 27, 2016.

* cited by examiner

*Primary Examiner* — Igor Kershteyn
(74) *Attorney, Agent, or Firm* — Ked & Associates LLP

(57) ABSTRACT

An indoor device for an air conditioner is provided. The indoor device may include a heat exchanger mounting panel in which an orifice to pass air therethrough is formed, a centrifugal fan to inhale air in a shaft direction through the orifice and discharge the air in a radial direction, a motor to rotate the centrifugal fan, and a case to fix the motor and couple the motor to the panel. A first magnetic substance and a second magnetic substance that generate a repulsive force may be respectively disposed at a first surface opposite to the centrifugal fan in the panel and a second surface opposite to the panel in the centrifugal fan. In the first magnetic substance and the second magnetic substance, the same pole may be formed in a concentric circle and different poles may be alternately formed in a radial direction.

20 Claims, 9 Drawing Sheets

INDOOR DEVICE FOR AN AIR CONDITIONER

CROSS-REFERENCE TO RELATED APPLICATION(S)

This application claims priority under 35 U.S.C. §119 to Korean Application No. 10-2012-0129192 filed on Nov. 15, 2012, whose entire disclosure is hereby incorporated by reference.

BACKGROUND

1. Field

An indoor device for an air conditioner is disclosed herein.

2. Background

Indoor devices for air conditioners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
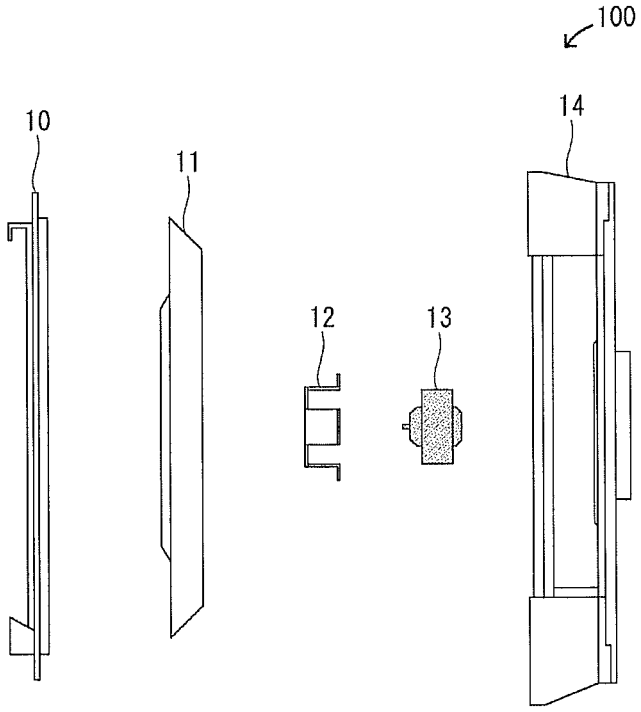
FIG. 1 is an exploded view of an indoor device for an air conditioner.

An air conditioner is a cooling and heating system that inhales indoor air, heat exchanges the air with heat with a refrigerant, and discharges the air to indoors. Further, an air conditioner is a device that forms a refrigerating cycle including a compressor-condenser-expander-evaporator arrangement.

Air conditioners may be divided into separated type air conditioners, in which an outdoor unit or device and an indoor unit or device are separately and installed, and an integral type in which an outdoor unit or device and an indoor unit or device are integrally installed. Presently, multi-type air conditioners, in which a plurality of indoor units or devices are connected to one outdoor unit or device and the plurality of indoor devices is installed in different spaces, are often employed.

In order to improve the appearance of air conditioners and to improve space efficiency, indoor devices may be mounted at or on a ceiling or a wall surface, and in order to reduce the occupying space of the indoor device, it may be advantageous to reduce a side surface thickness of the indoor device. However, due to vibration occurring in a rotating fan, there is a limitation in reducing a gap between the fan and an orifice panel or between the fan and a case. More particularly, when mounting the indoor device at or on a wall surface, in a state in which the fan does not rotate, the fan does not remain vertical with respect to a bottom thereof, but rather, a tilt phenomenon in which the fan is inclined due to a weight of the fan itself occurs, and thus, when the fan starts to rotate, vibration greatly occurs, and when reducing a gap between the panel or the case and the fan is reduced, the fan may collide with the panel or the case.

Hereinafter, an indoor device for an air conditioner according to embodiments will be described in detail with reference to the accompanying drawings. Where possible, like reference numerals have been used to indicate like elements, and repetitive disclosure has been omitted.

Figure 2:
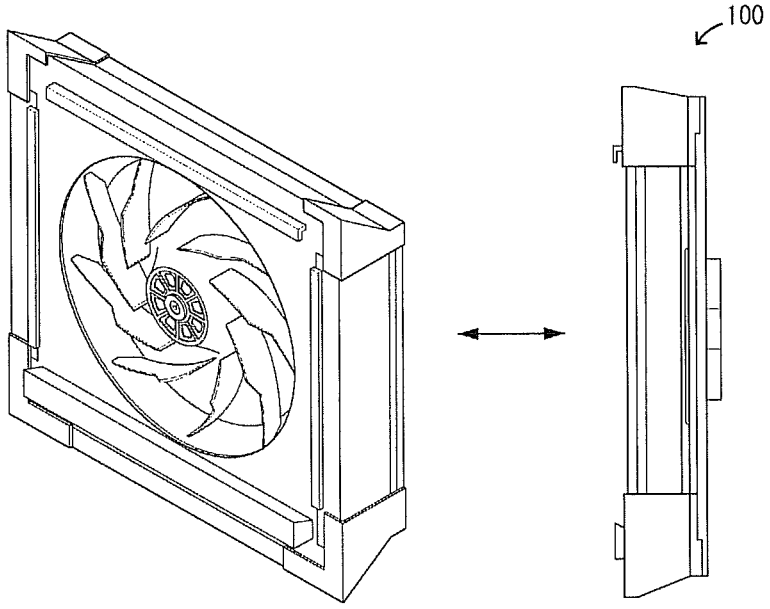
FIG. 2 is a perspective view and a side view of the indoor device for an air conditioner of FIG. 1.
Figure 3:
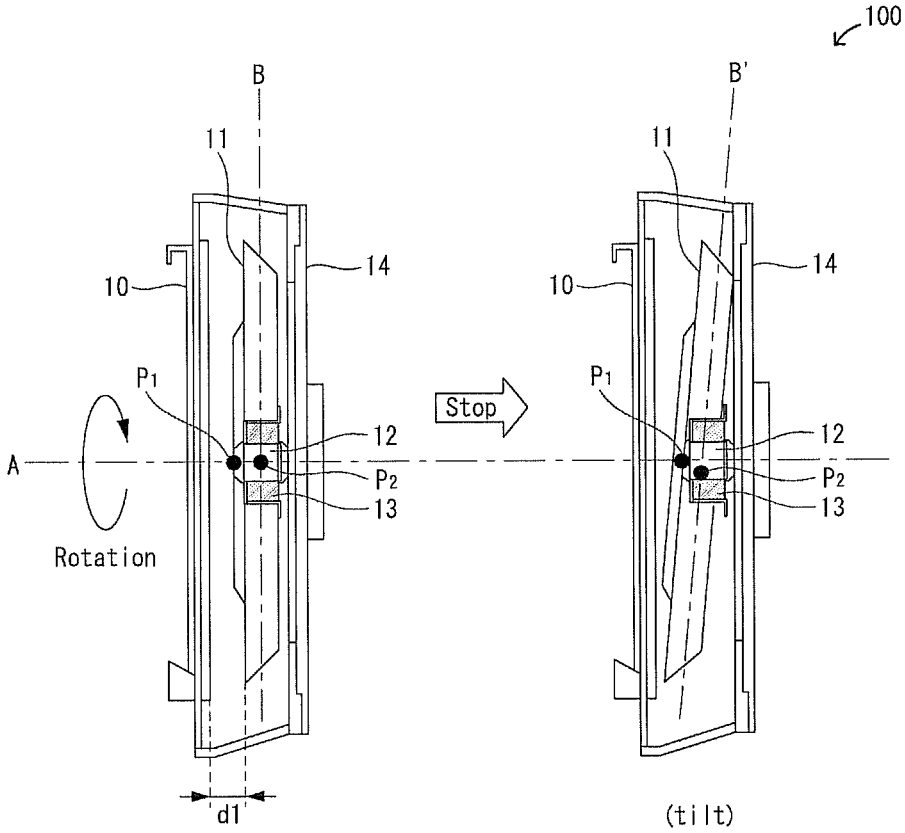
FIG. 3 illustrates an inclined centrifugal fan in a state in which the centrifugal fan of the indoor device for an air conditioner does not rotate.

FIG. 1 is an exploded view of an indoor device for an air conditioner, and FIG. 2 is a perspective view and a side view of the indoor device for an air conditioner of FIG. 1. FIG. 3 illustrates an inclined centrifugal fan in a state in which the centrifugal fan of the indoor device for an air conditioner does not rotate. As shown in FIG. 1, an indoor device 100 of the air conditioner may include a panel 10 to mount a heat exchanger, a centrifugal fan 11 having a plurality of blades, a motor 13 to rotate the centrifugal fan 11 at a high speed, and a holder 12 to securely fix the motor 13 to an inside of the case 14. As shown in FIG. 2, in the indoor device 100 of the air conditioner, the motor 13, the holder 12, the centrifugal fan 11, and the panel 10 may be sequentially fastened and assembled within a case 14.

However, as shown in FIG. 3, when the motor 13 is fastened in an inserted state within a hub depressed at a center of the centrifugal fan 11, an end portion of a rotational axis of the motor 13 fastened to the hub may be a rotation center $P_1$, but does not correspond to a gravitational center $P_2$, of the centrifugal fan 11, and may be separated by a predetermined gap from the gravitational center $P_2$. That is, due to separation between the rotational center $P_1$ of the motor 13 and the gravitational center $P_2$ of the centrifugal fan 11, when the centrifugal fan 11 rotates, vibration and noise may occur Further, when a rotation operation of the centrifugal fan 11 is stopped, a tilt phenomenon in which a plane B' perpendicular to a rotational shaft of the centrifugal fan 11 obliquely inclines clockwise, may occur, as shown in FIG. 3, and thus, allowable space (e.g., d1≈10 mm) within a predetermined gap, which should exist between a rear surface of the panel 10 and a front surface of the centrifugal fan 11, may be reduced. This may be an obstacle element in reducing a side surface thickness of the indoor device for an air conditioner.

Figure 4:
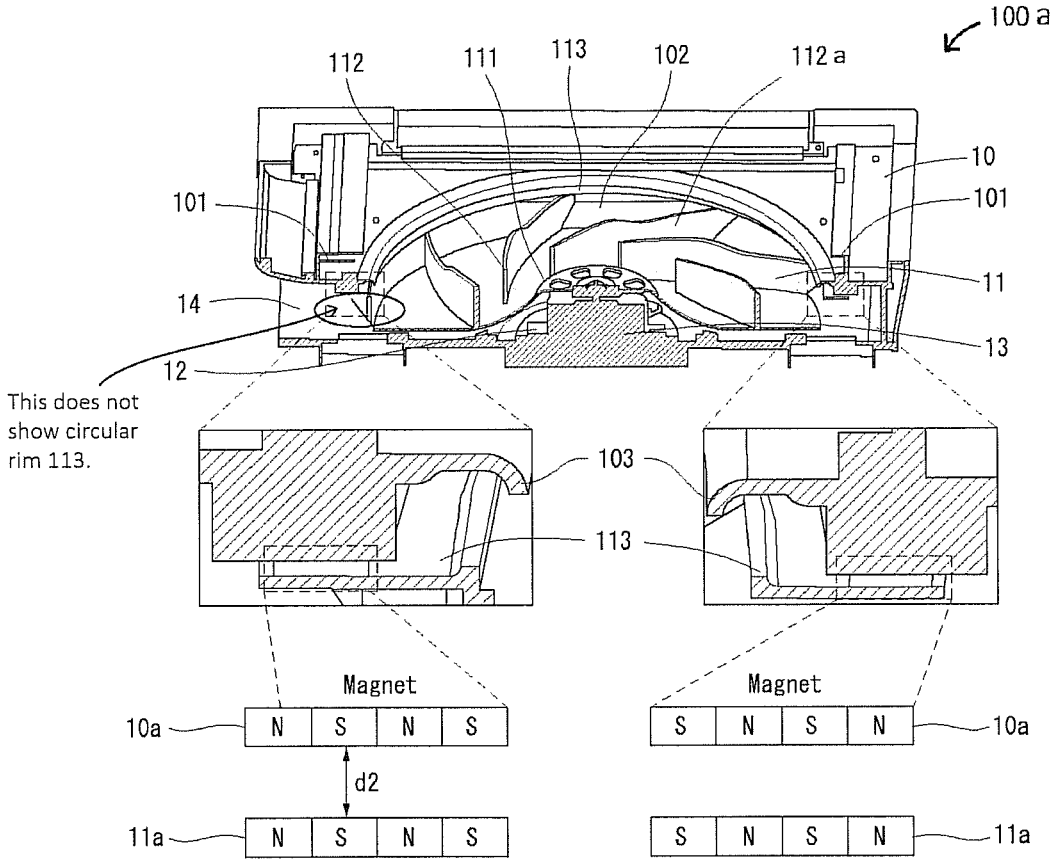
FIG. 4 is a cross-sectional view of an indoor device for an air conditioner according to embodiments.
Figure 5:
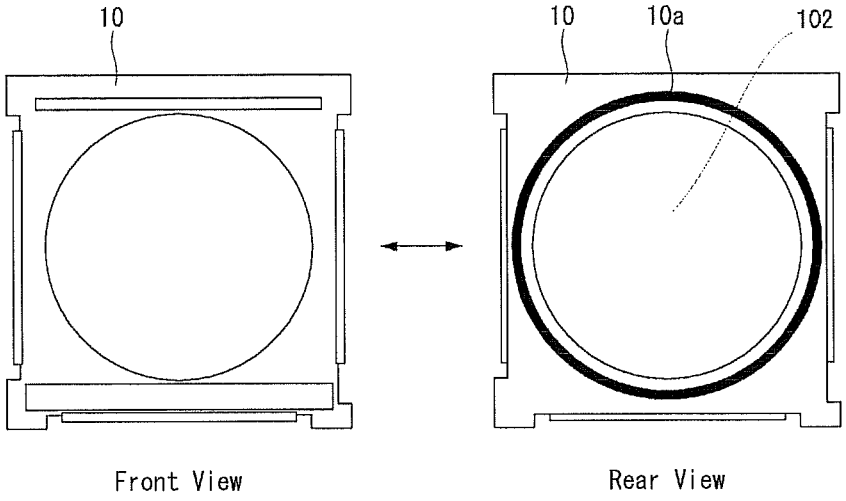
FIG. 5 is a front view and a rear view of a magnetic substance installed at a rear surface of a heat exchanging panel of the indoor device for an air conditioner according to embodiments.
Figure 6:
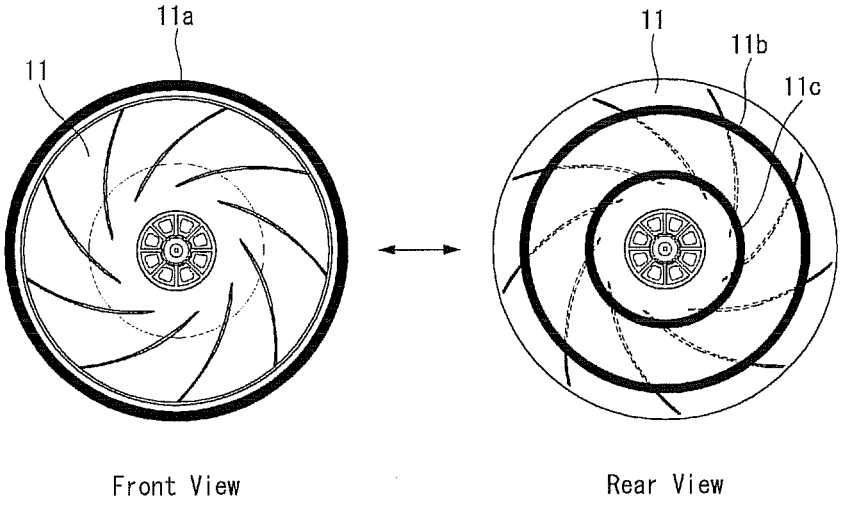
FIG. 6 is a front view and a rear view of a magnetic substance installed at a front surface and a rear surface of a centrifugal fan of the indoor device for an air conditioner according to embodiments.
Figure 7:
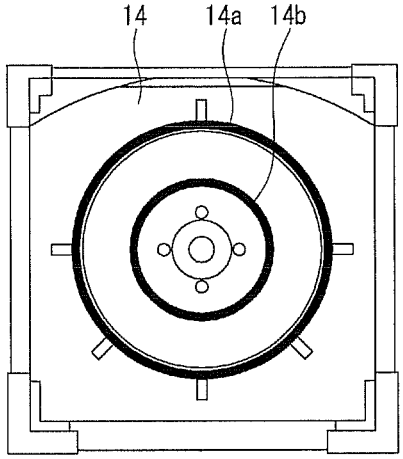
FIG. 7 illustrates a magnetic substance installed at an inside of a case of the indoor device for an air conditioner according to embodiments.
Figure 8:
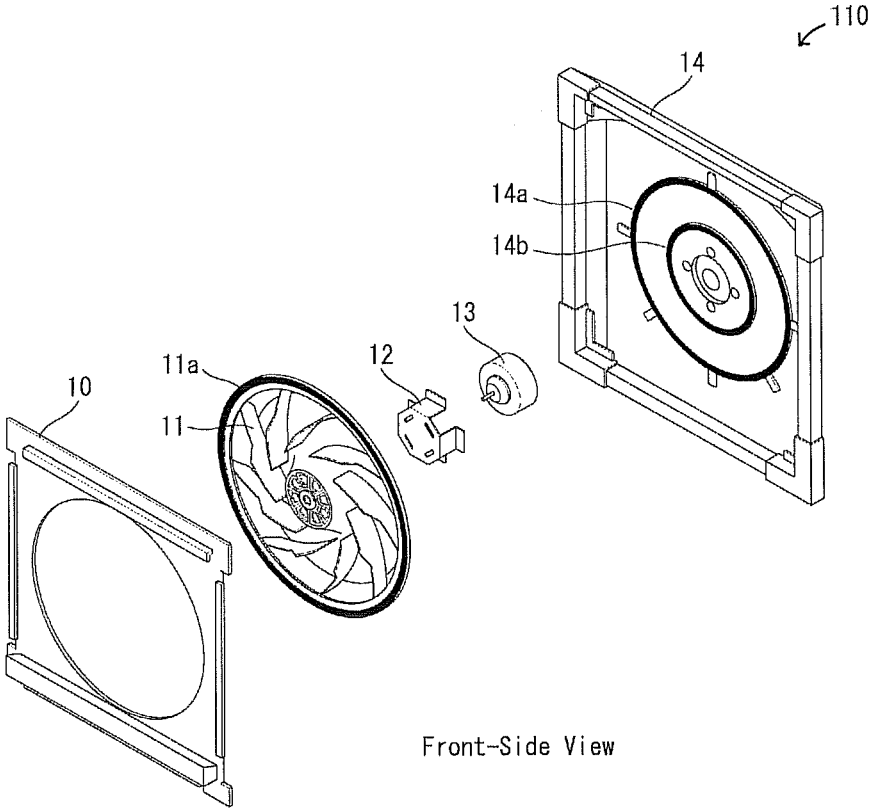
FIGS. 8 and 9 are exploded views of the indoor device for an air conditioner according to embodiments.
Figure 9:
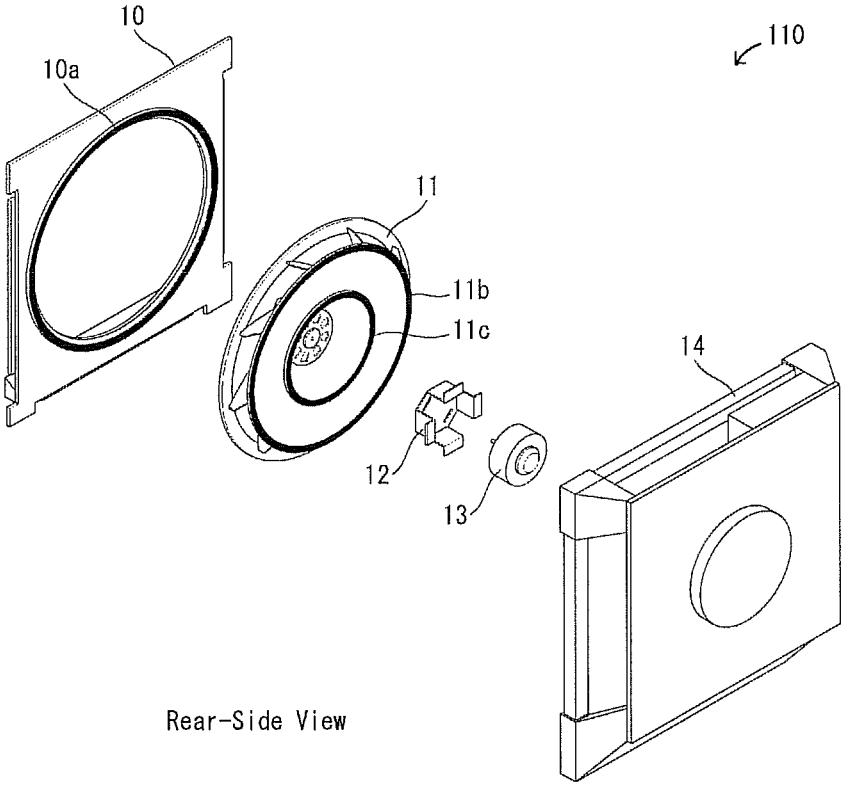
Figure 10:
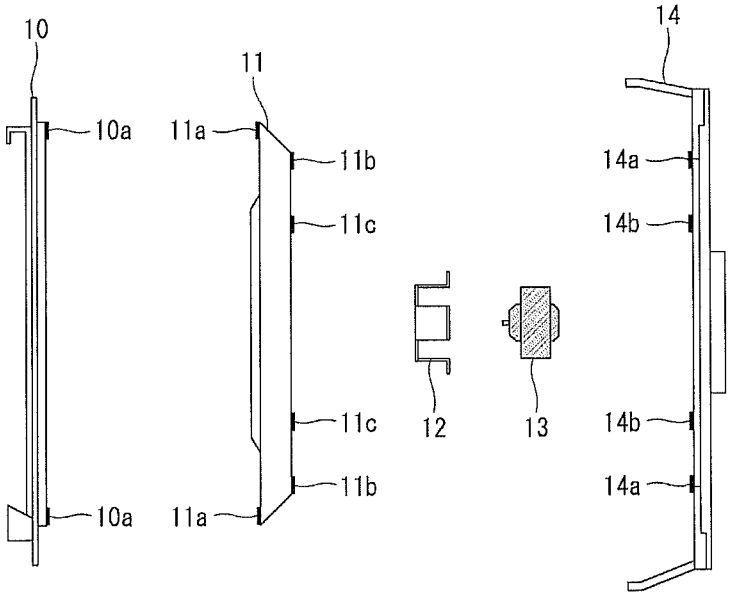
FIG. 10 is a side exploded view of the indoor device for an air conditioner according to embodiments.
Figure 11:
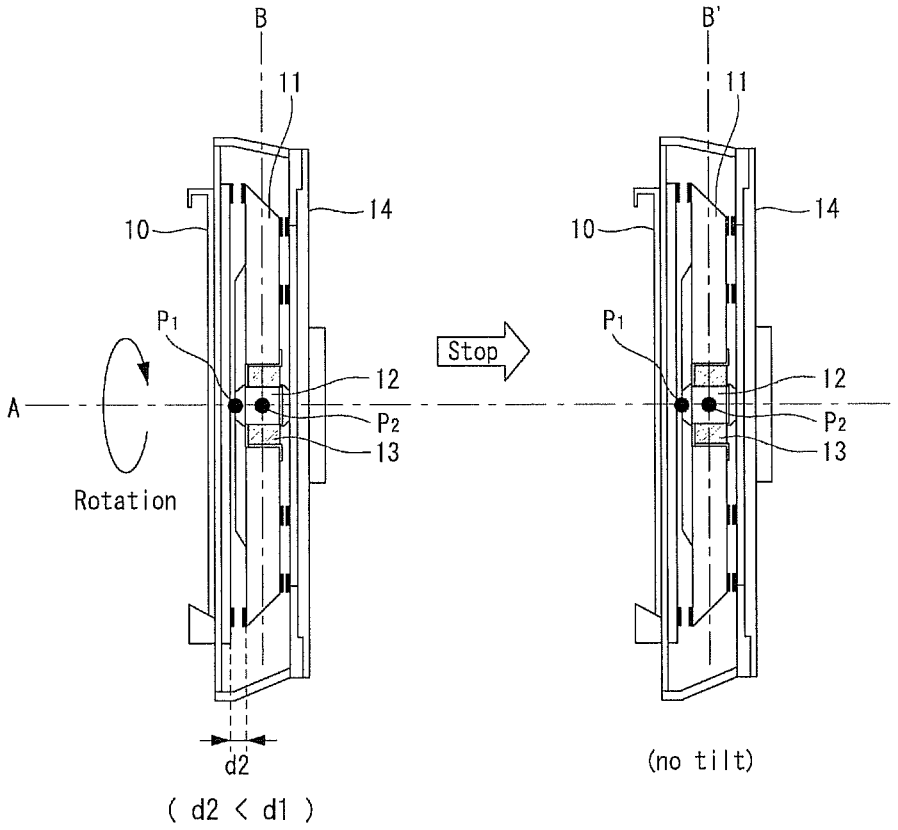
FIG. 11 illustrates the centrifugal fan, which is not inclined in a state in which the centrifugal fan of the indoor device for an air conditioner does not rotate according to embodiments.

FIG. 4 is a cross-sectional view of an indoor device for an air conditioner according to embodiments. FIG. 5 is a front view and a rear view of a magnetic substance installed at a rear surface of a heat exchanging panel of the indoor device for an air conditioner according to an embodiments. FIG. 6 is a front view and a rear view of a magnetic substance installed at a front surface and a rear surface of a centrifugal fan of the indoor device for an air conditioner according to embodiments. FIG. 7 illustrates a magnetic substance installed at an inside of a case of the indoor device for an air conditioner according to embodiments. FIGS. 8 and 9 are exploded views of the indoor device for an air conditioner according to embodiments. FIG. 10 is a side exploded view of the indoor device for an air conditioner according to embodiments. FIG. 11 illustrates the centrifugal fan, which is not inclined in a state in which the centrifugal fan of the indoor device for an air conditioner does not rotate according to an embodiments.

In the indoor device 100*a* for an air conditioner according to embodiments disclosed herein, as described above with reference to FIGS. 1 to 3, the heat exchanger mounting panel 10, the centrifugal fan 11, the holder 12, the motor 13, and the case 14 may be assembled and fastened together. In one embodiment, at a rear surface of the heat exchanger mounting panel 10, a first magnetic substance 10*a* may be installed, and at a front surface of the centrifugal fan 11, that is, at a surface facing an inhaling direction of air, a second magnetic substance 11*a* may be installed. By providing the first magnetic substance 10*a* installed at the rear surface of the panel 10 and the second magnetic substance 11*a* installed at the front surface of the centrifugal fan 11 to face each other with the same polarity, that is, an N pole or an S pole, at an opposite separate position, the first magnetic substance 10*a* and the second magnetic substance 11*a* may generate a repulsive force.

As shown in FIG. 4, in the panel 10, a heat exchanger holder 101 to mount a heat exchanger may be provided with, at a center thereof, an orifice 102 to pass inhaled air therethrough, and a bell mouse 103, a circumferential edge of an inner circumferential surface of which may be curved with a predetermined curvature so as to guide air inhaled by the centrifugal fan 11 to form the orifice 102.

The centrifugal fan 11 inhales air in an axis or shaft direction through the orifice 102 and discharges the air in a radial direction and may include a hub portion 111 coupled to a rotational shaft of the motor 13 and that covers the motor 13, a blade portion 112, one side of a plurality of blades 112*a* of which may be fixed to the hub portion 111 in a state in which the plurality of blades 112*a* extends in a direction away from the rotational shaft arranged with a predetermined gap therebetween, and a circular rim 113 formed at an outer circumference of the plurality of blades 112*a* and fixed to a side of the hub portion 111 opposite to a side at which the plurality of blades 112*a* is fixed to the hub portion 111.

The hub portion 111 may have a wide-brimmed hat shape, and an intermediate convex portion may be coupled to a rotational shaft of the motor 13, while covering the motor 13, and a brim portion may have the plurality of blades 112*a* of the blade portion 112 fixed thereto to guide air inhaled in the axis direction to flow in the radial direction.

The circular rim 113 may be formed at an outside of the blade portion 112 to extend further than an outer diameter of the orifice 102 formed by the bell mouse 103 to pass air therethrough, and the second magnetic substance 11*a* may be mounted at a surface facing the panel 10 in the circular rim 113. Further, the first magnetic substance 10*a* may be mounted at a position corresponding to the second magnetic substance 11*a* at a surface facing the circular rim 113 in the panel 10, that is, a rear surface of the panel 10 to generate a repulsive force with the second magnetic substance 11*a* arranged with the same polarity and to maintain a constant gap from the second magnetic substance 11*a*.

The first magnetic substance 10*a* and the second magnetic substance 11*a* may each be, for example, a ring-shaped magnet. Further, each may utilize a rubber magnet having flexibility. The first magnetic substance 10*a* may be installed adjacent an outer circumference of the orifice 102 formed at a center of the panel 10, as shown in FIG. 5. As shown in FIG. 6, as the second magnetic substance 11*a* may be installed at an outer circumference of a front surface of the centrifugal fan 11, in a state in which the first magnetic substance 10*a* and the second magnetic substance 11*a* face each other, the first magnetic substance 10*a* and the second magnetic substance 11*a* may generate a repulsive force.

As shown in FIG. 4, in the first magnetic substance 10*a* and the second magnetic substance 11*a*, the same pole may be formed in a concentric circle, and an N pole and an S pole, that is, different poles may be alternately formed in a radial direction. Thus, when the centrifugal fan 11 rotates, an eccentric phenomenon in which the rotational shaft of the motor vibrates may be reduced.

At a rear surface of the centrifugal fan 11, that is, at a rear surface of the hub portion 111, which is a surface opposite to a surface to which the plurality of blades 112*a* is fixed to the hub portion 111, as shown in FIG. 6, at least one of a third magnetic substance 11*b* and a fifth magnetic substance 11*c* may be installed, and as shown in FIG. 7, at an inside of the case 14, that is, at a surface opposite to a rear surface of the hub portion 111, at least one of a fourth magnetic substance 14*a* and a sixth magnetic substance 14*b* may be installed.

The third magnetic substance 11*b* and the fourth magnetic substance 14*a* may each be, for example, a ring-shaped magnet. The third magnetic substance 11*b* may be installed at a rear surface of the brim portion at an outer circumference of a rear surface of the centrifugal fan 11, and the fourth magnetic substance 14*a* may be installed at the inside of the case 14 opposite to the third magnetic substance 11*b*, and thus, the third magnetic substance 11*b* and the fourth magnetic substance 14*a* may generate a repulsive force in an opposite state or opposite direction.

As shown in FIG. 6, the fifth magnetic substance 11*c* may be, for example, a ring-shaped magnet having a diameter smaller than a diameter of the third magnetic substance 11*b* and may be installed at a rear surface of a portion corresponding to a brim portion of the hub portion 111. Further, as shown in FIG. 7, the sixth magnetic substance 14*b* may be, for example, a ring-shaped magnet having a diameter smaller than a diameter of the fourth magnetic substance 14*a* and may be installed at the inside of the case 14 opposite to the fifth magnetic substance 11*c*, and the sixth magnetic substance 14*b* may generate a repulsive force in a state facing the fifth magnetic substance 11*c*.

Alternatively, the fifth magnetic substance 11*c* installed at a rear surface of the centrifugal fan 11 and the sixth magnetic substance 14*b* installed at the inside of the case 14 may not be emitted, to reduce costs of an air conditioner.

In the third magnetic substance 11 b and the sixth magnetic substance 14*b*, the same pole may be formed in a concentric circle and different poles may be alternately formed in a radial direction, like the first magnetic substance 10*a* and the second magnetic substance 11*a*. Further, the third magnetic substance 11*b* and the sixth magnetic substance 14*b* may have a diameter smaller than a diameter of the first magnetic substance 10*a* and the second magnetic substance 11*a*.

FIGS. 8 and 9 are exploded views of the indoor device for an air conditioner according to embodiments. In the indoor device 110*a* for the air conditioner according to embodiments, the heat exchanger mounting panel 10, the centrifugal fan 11, the holder 12, the motor 13, and the case 14 may be sequentially fastened and assembled. At the rear surface of the panel 10, the first magnetic substance 10*a* may be installed, and at the front surface of the centrifugal fan 11, the second magnetic substance 11*a*, which may be ring-shaped, may be installed. Further, at the rear surface of the centrifugal fan 11, the third magnetic substance 11*b* and the fifth magnetic substance 11*c*, which may be ring-shaped, may be installed, and at the inside of the case 14, the fourth magnetic substance 14*a* and the sixth magnetic substance 14*b*, which may be ring-shaped, may be installed.

That is, a repulsive force may occur between the first magnetic substance 10*a* and the second magnetic substance 11*a*, a repulsive force may occur between the third magnetic substance 11*b* and the fourth magnetic substance 14*a*, and a repulsive force may occur between the fifth magnetic substance 11*c* and the sixth magnetic substance 14*b*. Accordingly, as shown in FIG. 11, even if allowable space d2 (d2<d1) is reduced between the rear surface of the panel 10 and the front surface of the centrifugal fan 11, the slim type air conditioner 100*a* may constantly maintain a gap between the rear surface of the panel 10 and the front surface of the centrifugal fan 11 by a repulsive force generated by the magnetic substances. Therefore, by suppressing vibration by generating the repulsive force by the corresponding magnetic substance pairs while the centrifugal fan rotates, noise may be reduced.

Further, as shown in FIG. 11, even if a rotational operation of the centrifugal fan 11 is stopped, a tilt phenomenon in which a plane B perpendicular to the rotational shaft of the centrifugal fan 11 is inclined clockwise may be prevented, by efficiently reducing allowable space (for example, d2≈4 mm) between the rear surface of the panel 10 and the front surface of the centrifugal fan 11, and a side surface thickness of the indoor device for an air conditioner may be reduced.

According to another embodiment, at the outer circumference of the rear surface of the centrifugal fan 11, that is, in the hub portion 111, the first magnetic substance 10*a* may be installed at the rear surface of an outer circumferential portion corresponding to the brim portion and the second magnetic substance 11*a* may be installed at the inside of the case 14. By installing the first magnetic substance 10*a* and the second magnetic substance 11*a* to be opposite to each other, while the centrifugal fan rotates, vibration may be suppressed or prevented from occurring, and thus, noise may be reduced. Further, even if the rotational operation of the centrifugal fan is stopped, a tilt phenomenon may be prevented, and thus, a side surface thickness of the indoor device for an air conditioner may be efficiently reduced.

That is, with this embodiment, the first magnetic substance 10*a* may be installed at the rear surface of the centrifugal fan 11 and the second magnetic substance 11*a* may be installed at the inside of the case 14. Further, the third magnetic substance 11*b* may be installed at the rear surface of the panel 10, the fourth magnetic substance 14*a* at the front surface of the centrifugal fan 11, the fifth magnetic substance 11*c* having a small diameter at the rear surface of the centrifugal fan 11, and a sixth magnetic substance 14*b* having a small diameter at the inside of the case 14 as a selective additional configuration.

Embodiments disclosed herein provide an indoor unit or device for an air conditioner that can reduce a thickness of a side surface. Embodiments disclosed herein further provide an indoor unit or device for an air conditioner in which a fan is not inclined even in a state in which the fan does not rotate, which enables the fan to not collide with a panel or a case when the fan rotates. Embodiments disclosed herein additionally provide an indoor unit or device for an air conditioner that may reduce generation of vibration or noise while a fan rotates.

Embodiments disclosed herein provide an indoor unit of an air conditioner that may include a heat exchanger mounting panel in which an orifice to pass air therethrough is formed, a centrifugal fan to inhale air in a shaft or axis direction through the orifice and discharge the air in a radiation or radial direction, a motor to rotate the centrifugal fan, and a case to fix the motor and couple the motor to the panel. A first magnetic substance and a second magnetic substance that generate a repulsive force may be respectively disposed at a first surface opposite to the centrifugal fan in the panel and a second surface opposite to the panel in the centrifugal fan. The first magnetic substance and the second magnetic substance may be formed with a ring-shaped magnet.

In the first magnetic substance and the second magnetic substance, the same pole may be formed in a concentric circle and different poles may be alternately formed in a radiation or radial direction. The first magnetic substance and the second magnetic substance may be formed with a rubber magnet.

In the panel, a circumferential edge of an inner circumferential surface may be curved with a predetermined curvature so as to guide air inhaled by the centrifugal fan to form the orifice. The first magnetic substance may be formed at the outer circumference further than the orifice.

The centrifugal fan may include a hub portion to couple to a rotation shaft of the motor, a blade portion in which one of the blades is fixed to the hub portion in a state in which a plurality of blades that extend in a direction receding from the rotation axis are arranged at a predetermined gap, and a circular rim formed at an outer circumference of the blade and fixed to the opposite side of the blade fixed to the hub portion. The second magnetic substance may be mounted in the circular rim.

A third magnetic substance and a fourth magnetic substance that generate a repulsive force may be respectively installed at a third surface, which may be an opposite surface of a surface to which the blade is fixed in the hub portion and a fourth surface opposite to the third surface in the case. The third magnetic substance and the fourth magnetic substance may be a ring-shaped magnet in which the same pole is formed in a concentric circle and in which different poles are alternately formed in a radiation direction. Further, the third magnetic substance and the fourth magnetic substance may have a diameter smaller than that of the second magnetic substance.

A ring-shaped fifth magnetic substance and sixth magnetic substance that generate a repulsive force may be respectively installed at the third surface. The fourth surface and the fifth magnetic substance and the sixth magnetic substance may have a diameter smaller than that of the third magnetic substance and the fourth magnetic substance.

Embodiments disclosed herein provide an indoor unit or device of an air conditioner that may include a heat exchanger mounting panel in which an orifice for to pass air therethrough is formed, a centrifugal fan to inhale air in a shaft or axis direction through the orifice and discharge air in a radiation or radial direction, a motor to rotate the centrifugal fan, and a case to fix the motor and couple the motor to the panel. The centrifugal fan may include a hub portion to couple to a rotation shaft of the motor and a blade portion in which one side of the blade may be fixed to the hub portion in a state in which a plurality of blades that extends in a direction receding from the rotation axis are arranged at a predetermined gap. A first magnetic substance and a second magnetic substance that generate a repulsive force may be respectively installed at a first surface, which is an opposite surface of a surface to which the blade is fixed in the hub portion and a second surface opposite to the first surface in the case.

The first magnetic substance and the second magnetic substance may be a ring-shaped magnet in which the same pole is formed in a concentric circle and in which different poles are alternately formed in a radiation direction. The first magnetic substance and the second magnetic substance may be formed with a rubber magnet. A third magnetic substance and a fourth magnetic substance that generate a repulsive force may be respectively disposed at a third surface opposite to the centrifugal fan in the panel and a fourth surface opposite to the panel in the centrifugal fan.

In the panel, a circumferential edge of an inner circumferential surface thereof may be curved with a predetermined curvature so as to guide air inhaled by the centrifugal fan to form the orifice, and the centrifugal fan may further include a circular rim formed at an outer circumference side of the blade and fixed to the opposite side of the blade fixed to the hub portion. The third magnetic substance may be formed at the outer circumference further than the orifice, and the second magnetic substance may be mounted in the circular rim.

The third magnetic substance and the fourth magnetic substance may be a ring-shaped magnet in which the same pole is formed in a concentric circle and in which different poles are alternately formed in a radiation direction. The third magnetic substance and the fourth magnetic substance may have a diameter larger than that of the first magnetic substance and the second magnetic substance.

With such feature, a tilt phenomenon in which a centrifugal fan is inclined in a stop state may be prevented, and a gap between a panel and a centrifugal fan may be reduced, and thus a side surface thickness of an indoor unit or device of an air conditioner may be efficiently reduced, and furthermore, while the centrifugal fan rotates, by suppressing vibration from occurring, noise may be reduced.

The exemplary embodiments should be considered in descriptive sense only and not for purposes of limitation. Therefore, the scope of embodiments is defined not by the detailed description but by the appended claims, and all differences within the scope will be construed as being comprised in the embodiments.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor device for an air conditioner, comprising:

a heat exchanger mounting panel in which an orifice to pass air therethrough is formed;

a centrifugal fan to inhale air in a shaft direction through the orifice and discharge the air in a radial direction;

a motor to rotate the centrifugal fan; and a case to fix the motor and couple the motor to the panel, wherein a first magnetic substance and a second magnetic substance that generate a repulsive force are respectively disposed at a first surface opposite to the centrifugal fan in the panel and a second surface opposite to the panel in the centrifugal fan.

2. The indoor device of claim 1, wherein the first magnetic substance and the second magnetic substance each comprises a ring-shaped magnet.

3. The indoor device of claim 2, wherein in the first magnetic substance and the second magnetic substance, the same pole is formed in a concentric circle.

4. The indoor device of claim 3, wherein in the first magnetic substance and the second magnetic substance, different poles are alternately formed in a radial direction.

5. The indoor device of claim 2, wherein the first magnetic substance and the second magnetic substance each comprises a rubber magnet.

6. The indoor device of claim 1, wherein a circumferential edge of an inner circumferential surface of the panel is curved with a predetermined curvature to form the orifice so as to guide air inhaled by the centrifugal fan, and wherein the first magnetic substance is disposed adjacent an outer circumference of the orifice.

7. The indoor device of claim 6, wherein the centrifugal fan comprises:

a hub portion to couple to a rotational shaft of the motor;

a blade portion, a first side of a plurality of blades of which is fixed to the hub portion in a state in which the plurality of blades extends in a direction away from the rotational axis with a predetermined gap formed therebetween; and a circular rim formed at an outer circumference of the plurality of blades and fixed to a second side of the plurality of blades opposite to the first side fixed to the hub portion, wherein the second magnetic substance is disposed at the circular rim.

8. The indoor device of claim 7, wherein a third magnetic substance and a fourth magnetic substance that generate a repulsive force are respectively disposed at a third surface, which is a surface opposite to a surface to which the plurality of blades is fixed in the hub portion, and a fourth surface opposite to the third surface in the case, respectively.

9. The indoor device of claim 8, wherein the third magnetic substance and the fourth magnetic substance each comprises a ring-shaped magnet in which the same pole is formed in a concentric circle.

10. The indoor device of claim 9, wherein different poles are alternately formed in a radial direction in the ring-shaped magnet.

11. The indoor device of claim 9, wherein the third magnetic substance and the fourth magnetic substance each have a diameter smaller than a diameter of the second magnetic substance.

12. The indoor device of claim 9, wherein a fifth magnetic substance and a sixth magnetic substance that generate a repulsive force are respectively disposed at the third surface. and the fourth surface.

13. The indoor device of claim 12, wherein the fifth magnetic substance and the sixth magnetic substance each comprises a ring-shaped magnet and have a diameter smaller than a diameter of the third magnetic substance and the fourth magnetic substance.

14. An air conditioner comprising the indoor device of claim 1.

15. An indoor device for an air conditioner, comprising:

a heat exchanger mounting panel in which an orifice to pass air therethrough is formed;

a centrifugal fan to inhale air in a shaft direction through the orifice and discharge the air in a radial direction;

a motor to rotate the centrifugal fan; and a case to fix the motor and couple the motor to the panel, wherein the centrifugal fan comprises a hub portion to couple to a rotational shaft of the motor and a blade portion, a first side of a plurality of blades of which is fixed to the hub portion in a state in which the plurality of blades extends in a direction away from the rotational axis with a predetermined gap therebetween, and wherein a first magnetic substance and a second magnetic substance that generate a repulsive force are respectively disposed at a first surface, which is a surface opposite to a surface to which the plurality of blades is fixed in the hub portion and a second surface opposite to the first surface in the case.

16. The indoor device of claim 15, wherein the first magnetic substance and the second magnetic substance each comprises a ring-shaped magnet in which the same pole is formed in a concentric circle, and different poles are alternately formed in a radial direction in the ring-shaped magnet.

17. The indoor device of claim 15, wherein a third magnetic substance and a fourth magnetic substance that generate a repulsive force are respectively disposed at a third surface opposite to the centrifugal fan in the panel and a fourth surface opposite to the panel in the centrifugal fan.

18. The indoor device of claim 17, wherein a circumferential edge of an inner circumferential surface of the panel is curved with a predetermined curvature to form the orifice so as to guide air inhaled by the centrifugal fan, wherein the centrifugal fan further comprises a circular rim formed at an outer circumference side of the plurality of blades and fixed to a second side opposite to the first side of the plurality of blades fixed to the hub portion, and wherein the third magnetic substance is formed adjacent an outer circumference of the orifice, and the fourth magnetic substance is mounted in the circular rim.

19. The indoor device of claim 18, wherein the third magnetic substance and the fourth magnetic substance each comprises a ring-shaped magnet in which the same pole is formed in a concentric circle, and different poles are alternately formed in a radial direction in the ring-shaped magnet.

20. The indoor device of claim 19, wherein the third magnetic substance and the fourth magnetic substance each have a diameter larger than a diameter of the first magnetic substance and the second magnetic substance.

* * * * *